US006059391A

United States Patent [19]

Fulkerson et al.

[11] Patent Number: 6,059,391

[45] Date of Patent: May 9, 2000

[54] APPARATUS AND METHOD FOR INK JET PRINTING ON LARGE OR IRREGULAR FABRICS

[76] Inventors: Timothy Jerome Fulkerson; Dawn Ai Robinson, both of 116 Hanupaoa Pl., Honolulu, Hi. 96822

[21] Appl. No.: 08/912,853

[22] Filed: Aug. 19, 1997

[51] Int. Cl.[7] ..... B41J 3/00

[52] U.S. Cl. ..... 347/2; 226/43; 242/543; 101/44; 68/205 R

[58] Field of Search ..... 347/2, 4, 8, 106, 347/93, 96; 226/43; 242/543; 101/41, 43, 44, 114, 115, 123, 124; 400/56–60; 8/150, 445, 457; 68/205 R

[56] References Cited

U.S. PATENT DOCUMENTS

| | | | |
|---|---|---|---|
| 3,894,413 | 7/1975 | Johnson | 68/205 R |
| 4,412,232 | 10/1983 | Weber et al. | 347/2 |
| 4,702,742 | 10/1987 | Iwata et al. | 8/495 |
| 5,176,076 | 1/1993 | Azuma et al. | 101/123 |
| 5,345,863 | 9/1994 | Kurata et al. | 347/4 |
| 5,631,684 | 5/1997 | Takaide et al. | 347/106 |
| 5,786,841 | 7/1998 | Bobb et al. | 347/217 |

FOREIGN PATENT DOCUMENTS

| | | | |
|---|---|---|---|
| 404197668 | 7/1992 | Japan | 347/8 |

*Primary Examiner*—John Barlow
*Assistant Examiner*—Juanita Stephens
*Attorney, Agent, or Firm*—Leland K. Jordan

[57] ABSTRACT

An ink-jet printing technique for printing on flat or seamed or irregular surfaced fabric sections or on seamed or irregular continuous rolls of fabric, for example as caused by hems or collars. The position of an ink-jet printing head is automatically adjusted to compensate for such surface irregularities within the fabric. Ultra-fine filtration during production of aqueous-based inks provides ink-jet printed patterns having desirable color clarity and permanence.

3 Claims, 14 Drawing Sheets

APPARATUS AND METHOD FOR INK JET PRINTING ON LARGE OR IRREGULAR FABRICS

FIELD OF THE INVENTION

This invention relates to a method for ink-jet printing upon a textile material, and, in particular, relates to an ink-jet printing method suitable for producing washable, colorfast images on garments and or large or uneven sections of fabric using aqueous-based inks.

BACKGROUND OF THE INVENTION

Historically, the production of a colored image onto textile fabrics or cloth has been accomplished using screen printing techniques which require an image bearing screen for each color to be printed. Screen-printed images or patterns are transferred to the fabric by sequentially forcing ink of different colors through the screen to replicate the colors in the image. Such processes are expensive and time consuming even with mechanical assistance since separate artwork and printing steps are required for each color in the image to be printed.

Ink-jet printing, where minute droplets of ink are formed by various mechanisms and injected from nozzles onto a target surface, is capable of more rapidly generating multi-colored images and has recently begun to be used when printing on fabric. In order to produce an imaged pattern having desired sharpness, a combination of image resolution and color clarity, and permanence, ink-jet printing on fabric has generally been found to require special fabrics and pre-processing treatments. Moreover, since ink-jet printers are designed to print on paper, the fabric to be printed is typically backed with a special paper layer or else the cloth is pre-treated with organic materials intended to increase ink receptivity and reduce the amount of image spread, arising from bleeding of printed inks. An existing need within the industry is to provide ink-jet printed color images with the desired levels of sharpness and permanence without these special requirements.

Special inks for ink jet printing on fabric have also been developed to have durability in wearing and washing at the same time being printable onto fabric without undue bleeding of the image. These inks are made from a variety of dyes including disperse dyes, acid dyes, and reactive dyes, and may be used singly or in combination.

A specialty industry for screen printing, particularly onto cotton tee-shirts, has grown rapidly as a result of trends toward personality individualization. The creation of personalized, creative designs or images using a personal computer system loaded with graphic image applications has not eliminated the use of transfer sheets since ink jet printing machines are designed to operate with flat paper and these are not suited to handle cloth materials, especially fabrics which have uneven surfaces or seams between sections. In addition, the size of the image to be printed is limited to the size of paper normally feed through ink-jet printing machines and thus existing ink-jet printers are not well suited for volume production of large rolls of textile fabrics.

Examples of known art that has been developed to facilitate printing on textile fabrics with ink-jet techniques include U.S. Pat. No. 5,594,485 wherein ink jet printing is disclosed on a silk cloth composed mainly of fibers with special dernier and moisture characteristics, the suitability of silk being dependent from its fibrin sericin protein filament polymeric base formed through amino-acid condensation. To enhance image sharpness, the moisture percentage of the silk cloth is controlled by adding a metallic salt or a water-soluble high molecular weight polymer into the silk cloth.

U.S. Pat. No. 5,500,023 discloses an ink-jet printing process in which ink droplets of at least two inks of different colors are applied to a cloth to form a pattern, following which the cloth is subjected to a heat treatment to fix dyes contained in the cloth, and the, the cloth is washed to remove unfixed dyes from the cloth. In this process, the inks comprise water and an organic solvent and the individual reactive dyes have different reaction rates.

U.S. Pat. No. 5,403,358 discloses ink jet printing on cloth using a reactive dye that is enhanced by pre-treating the cloth with a color enhancing agent which comprises urea and a quaternary ammonium compound.

U.S. Pat No. 4,969,951 discloses an ink jet printing ink comprising a reactive disperse dye dispersed or dissolved in an aqueous liquid medium and then subjecting the cloth to dye fixing treatment. The reactive disperse dyes are slightly water-soluble azo or anthraquinone or other types of dyes having groups which can react with hydroxyl or amino groups of the fibers to form covalent bonds with the fibers.

U.S. Pat. No. 4,725,849 describes an ink-jet system for printing on pretreated cloth where the surface of cloth to be printed is previously provided with an ink-receiving hydrophilic resin solution.

U.S. Pat. No. 4,702,742 describes an ink jet printing process for textile printing which deposits an receptor material for ink onto the cloth to be printed, the receptor including natural and synthetic polymers, such as wheat flour rice powder and polyamides. To reinforce the adhesion of the ink acceptor to a substrate, a latex binder may be used.

U.S. Pat. No. 4,547,786 describes an ink jet printing system wherein a plurality of rigid panels are moved edgewise and rectilinearly in succession past an ink jet printing station by an endless carrier so that the ink jet printing head scans a line on each panel as it passes the printing station. Each ink jet printing head is moved in a direction perpendicular to the path of panel movement, in coordination with the panel movement to cause the head to scan a new line on the panel each time the panel passes the printing station.

U.S. Pat. No. 4,116,626 describes an textile carpet printing system in which a series of gun bars, each containing plural dye jets extending across the width of an endless conveyor, each gun bar having a plurality of individual jet orifices, each of the different gun bars containing a different color dye.

In view of the foregoing discussion, it is believed to be advantageous to provide a method for ink jet printing on fabric which does not require a special type of fabric or special pre-treating of the fabric, and which does not use backing or transfer papers to produce a printed image having a desired level of sharpness and permanence. Another shortcoming not addressed in the prior art is the ability to print patterns on fabrics having irregular surface features, such as seams or pockets, and on fabrics not having the thin, flat and uniform thickness properties of paper. A further shortcoming not addressed in the industry is the ability to continuously print patterns on large quantities of fabric using ink jet methods.

SUMMARY OF THE INVENTION

It is accordingly an object of this invention to provide a method for ink-jet printing an image on a variety of fabrics of different sizes and compositions including continuous rolls or single pieces of fabric material with a plurality of colored inks, the fabric formed from materials like cotton, viscose, silk, linen, and wool, the inks having reactive dyes between the range of 0.5 and 1% by weight in an aqueous liquid medium, wherein no organic pre-treatment is applied to the fabric, wherein no backing paper is required for the fabric, and wherein no organic solvent is contained in the inks. Further, this invention provides for ink-jet printing on fabrics having irregular surface features wherein a constant distance is maintained between the ink-jet printing heads and the fabric by moving the ink-jet printing heads a distance normal to the fabric by an amount corresponding to the height of the irregular surface features. Still further, the present invention further provides an ultra-fine filtration process to produce the aqueous-based inks from dyes used in practicing both of these processes.

BRIEF DESCRIPTION OF THE DRAWINGS

The present ink-jet printing invention may be more fully understood from the following detailed description taken in connection with the accompanying drawings wherein.

DESCRIPTION OF THE PREFERRED EMBODIMENTS

Figure 1:
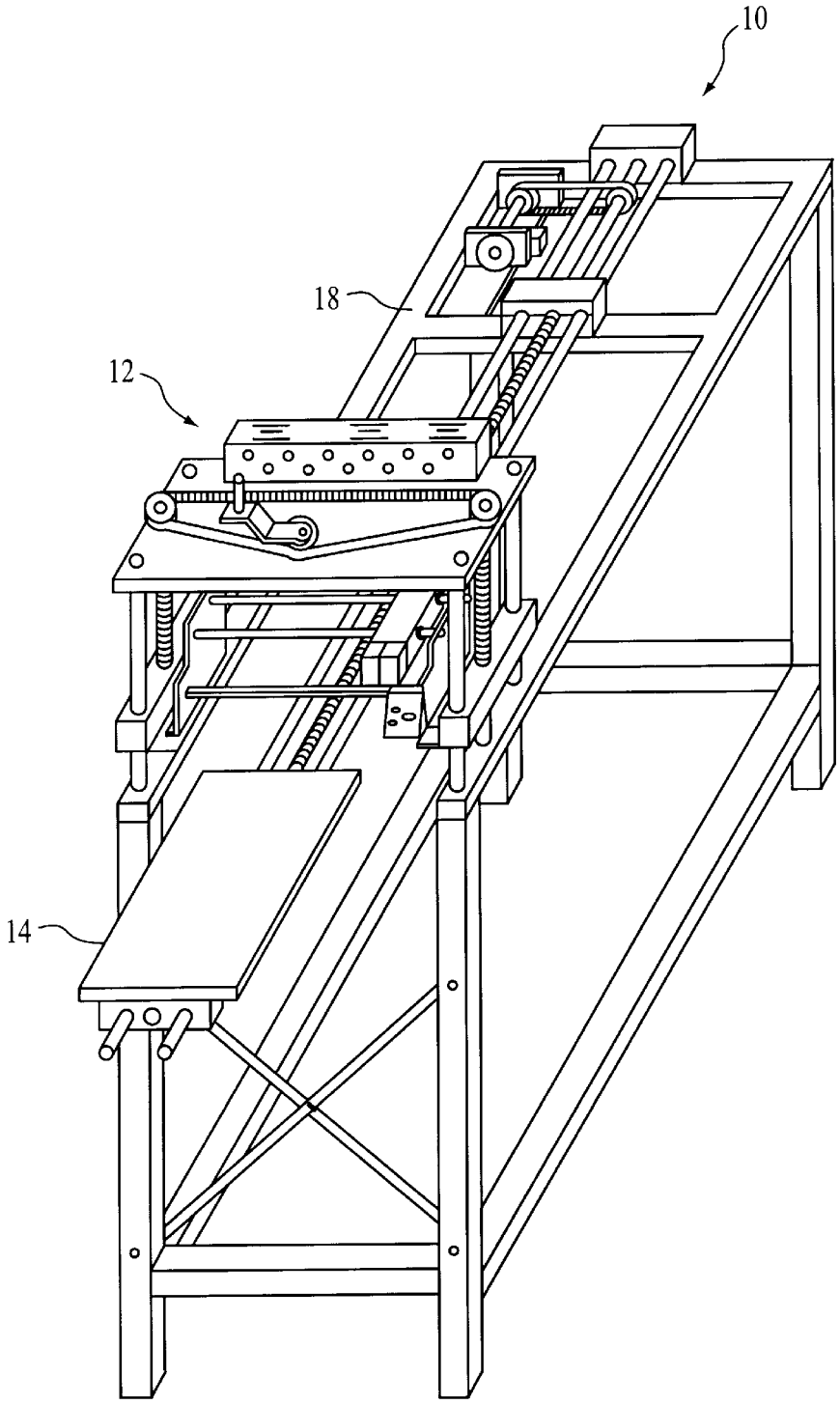
FIG. 1 is perspective view of a ink jet printing apparatus having an ink-jet printing station and a printing palette, both in accordance with the present invention.

Exemplary embodiments of the ink-jet printing method according to the present invention are presented only with those components of primary interest relative to the inventive apparatus and process. For purposes of clarity, many of the mechanical and electrical elements for driving and controlling the various components of the printing apparatus are not illustrated in the drawings. In particular, a control panel which provides for the electrical control of the printing apparatus as well as for the supply of an electronic image representing the pattern to be printed is not shown as such panels and their operation including the wiring of feed timing cams and position switches are well known within the industry. These omitted elements may take on any of a number of known forms which may be readily realized by one of normal skill in the art having knowledge of the information concerning the mode of operation of the system and of the various components and related processes utilized for printing fabrics as provided herein. Many of the mechanical and electrical elements have features and production techniques well known in the printing industry; as such, items such as guide rods, threaded shafts, motors, belts and operations like attach and secure are not described in detail so that the reader may focus on the inventive portions of the present invention.

Figure 2:
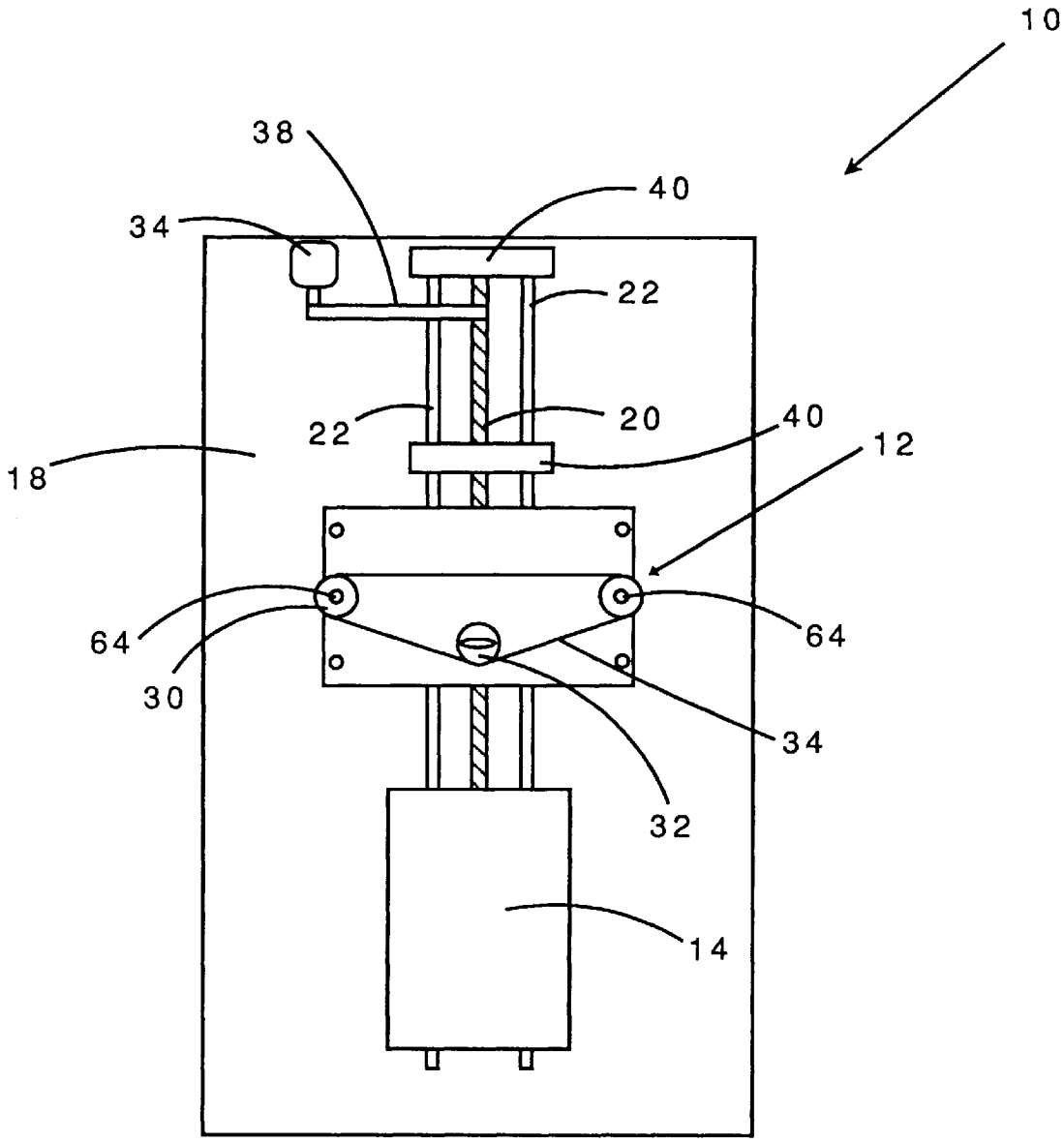
FIG. 2 is a schematic top plan view of the ink-jet printing station and printing palette of FIG. 1.
Figure 3:
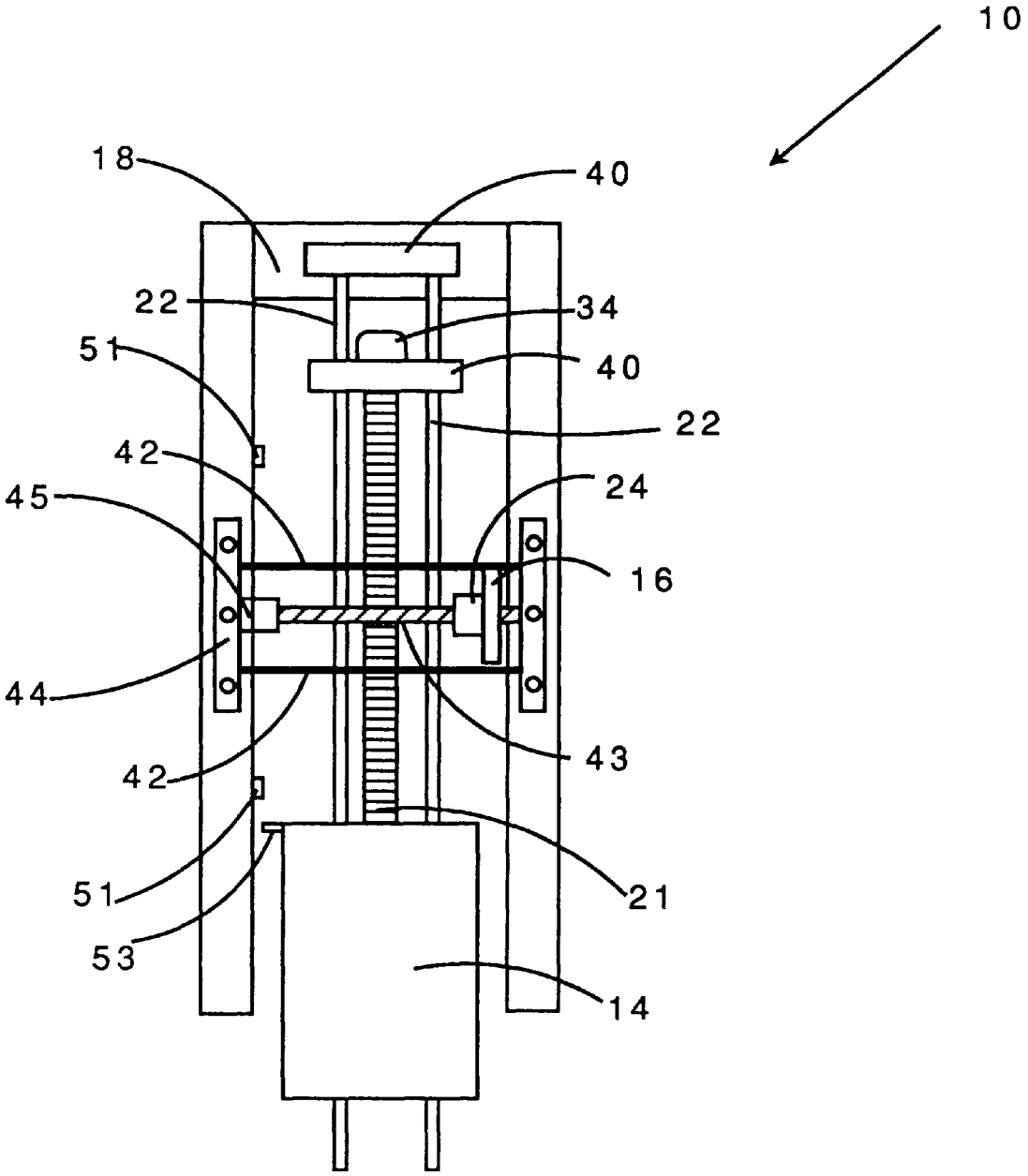
FIG. 3 is a schematic top plan view with portions of the jet printing station of FIG. 2 removed to show an ink-jet printing head and carrier.

Referring to the drawings, FIG. 1 illustrates in perspective an ink jet printing apparatus 10 for printing an image on a single section of fabric material having a stationary ink-jet printing station 12 for printing with ink and a movable printing palette 14 for supporting and transporting the fabric to be printed, the station 12 and the palette 14 adapted for relative movement therebetween in accordance with the present invention. FIGS. 2 and 3 show further details of ink-jet printer 10 wherein printing palette 14 has an upper surface for passing a piece of fabric in a plane beneath printing station 12 secured to the upper surface of a platform 18 (seen in FIG. 2), the printing palette 14 mounted on the upper surface of the platform 18 and moveable along a pair of tracks 22 forming a plane parallel to the upper surface of the frame or platform 18 and below the printing station 12 to provide relative movement between the printing station 12 and the palette 14. Printing station 12 comprises an ink-jet printing head 24 having printing nozzles 47 (best seen in FIG. 7) directed toward the palette 14, the ink-jet printing head 24 being mounted on a printing carriage 16, the carriage 16 being moveable in a direction perpendicular to movement of the printing palette 14 and in a plane parallel to tracks 22. When a printing signal, representative of a pattern to be printed, is received by the printing head 24, ink of a predetermined color flows from an ink reservoir 15 through appropriate tubing 17 (seen in FIGS. 7 and 9) and is jetted from the printing nozzle 47 to form colored dots on the fabric supported on the palette 14 in a pattern corresponding to the image being printed using a conventional ink-jet printing technique like those described hereinafter. As shown in FIG. 2, palette 14 is coupled to a threaded drive shaft 20 and slideably secured onto a pair of parallel tracks 22 engaged within a block (not shown) attached to and beneath printing station 12 so that palette 14 is moveable below printing station 12 in response to rotation of the threaded worm drive shaft 20 by a motor 34. The threaded drive shaft 20 and pair of parallel tracks 22 may be mounted as shown in a cantilevered manner secured at one end within a pair of palette supports 40. Alternately, as shown in FIG. 3, palette 14 may be moved by a continuous belt 21 driven by a belt drive motor 23 anchored below one of the palette supports 40, belt 21 rotating through an idler pulley 25 (see FIG. 8) attached to and beneath palette 14, so that palette 12 is moveable below printing station 12 in response to rotation of the continuous belt 21 by belt drive motor 23. As described in conjunction with FIG. 8, a pair of gear rollers 30 may be rotated by a timing drive belt 34 as driven by a bell crank 32 to impart movement of printing station 12 in a direction vertical to platform or frame 18 and to the printing palette 14 so as to accommodate different printing fabrics secured atop palette 14 and having differing thicknesses.

As used herein, the term "ink-jet printing" refers to the formation of a pattern on a textile material, e.g., cotton cloth, by means of an ink-jet printer using inks having a variety of colors. Cloths for use in the present invention are those made from natural fibers including cotton, wool, silk, some synthetic fibers including rayon and nylon fibers, wherein no organic pre-treatment is applied to the fabric prior to printing and wherein no backing paper is applied to the fabric to facilitate the printing process. The term "ink jet printer" refers to an electromechanical device adapted to deposit ink on a fabric in a pattern. The term "pattern" includes, but is not being limited to, any type of design, mark, figure, identification code, graphic, word, image, or the like.

In an ink-jet printer, ink is forced through a tiny nozzle (or a series of nozzles) to form droplets. In one scheme, the droplets are electrostatically charged and are attracted to an oppositely charged palette behind the material to be printed. By means of electrically controlled deflection plates, the trajectories of the droplets can be controlled to hit the desired spot on the material. Other common schemes use a piezoelectric device to vary the volume of a pressure chamber thereby generating ink ejection pressure. To eject ink during printing, the piezoelectric device is gradually discharged to increase the volume of the pressure chamber, and an electrical pulse is again applied to the piezoelectric device to rapidly charge the device and decrease the pressure chamber volume, thereby ejecting ink from the nozzle. A standard Epson 400 ink jet printer, available from Epson of America, has been found to be particularly useful, the printing head and nozzle and ink-feed portion and printing electronics thereof being used without modifications except for minor mechanical changes for feed timing cams and switches and various mountings, etc. Other ink jet printing techniques employ pressure generated by heating the ink to generate bubbles, all of these processes being well known in the printing industry and being suitable with nominal mechanical modifications in the practice of the present invention.

FIG. 2 additionally shows a drive motor 34, preferably a stepper motor, adapted with a timing drive belt 38 to provide rotational movement to threaded drive shaft 20, thereby to cause the printing palette 14 to move in a carefully controlled step-wise manner below printing station 12. The pair of tracks 22 as well as threaded drive shaft 20 being secured and rotationally engaged, respectively, in a palette mounting block 40 located near an end of platform 18.

Printing carriage 16 is slideably mounted on a threaded rod 43 extending between side blocks 44 and anchored in side blocks 44 between a pair of frame braces 42 so that perpendicular movement of the carriage 16 having a printing head 24 thereon across the printing palette 14 may be effected using a gear motor 45 mounted to an end block 44 or alternately integrated into carriage 16 in cooperation with the threaded rod 43. Due to this arrangement, carriage 16 can move along the threaded rod 43, making it possible for an ink-jet nozzle 47 (seen in FIG. 7) within printing head 24 to move across the area of a fabric secured onto palette 14 and produce an ink-jet printed pattern thereon. Printing head 24, ink-jet nozzle 47, and the associated image handling and printing control electronics may be obtained from a standard ink-jet printer, such as the aforementioned Epson 400 model. Ink-jet printing with this arrangement on various cotton and synthetic fabrics, and using the printing inks described hereinafter, produces printed patterns having color density and permanence comparable to products produced using screen printing technology.

Figure 4:
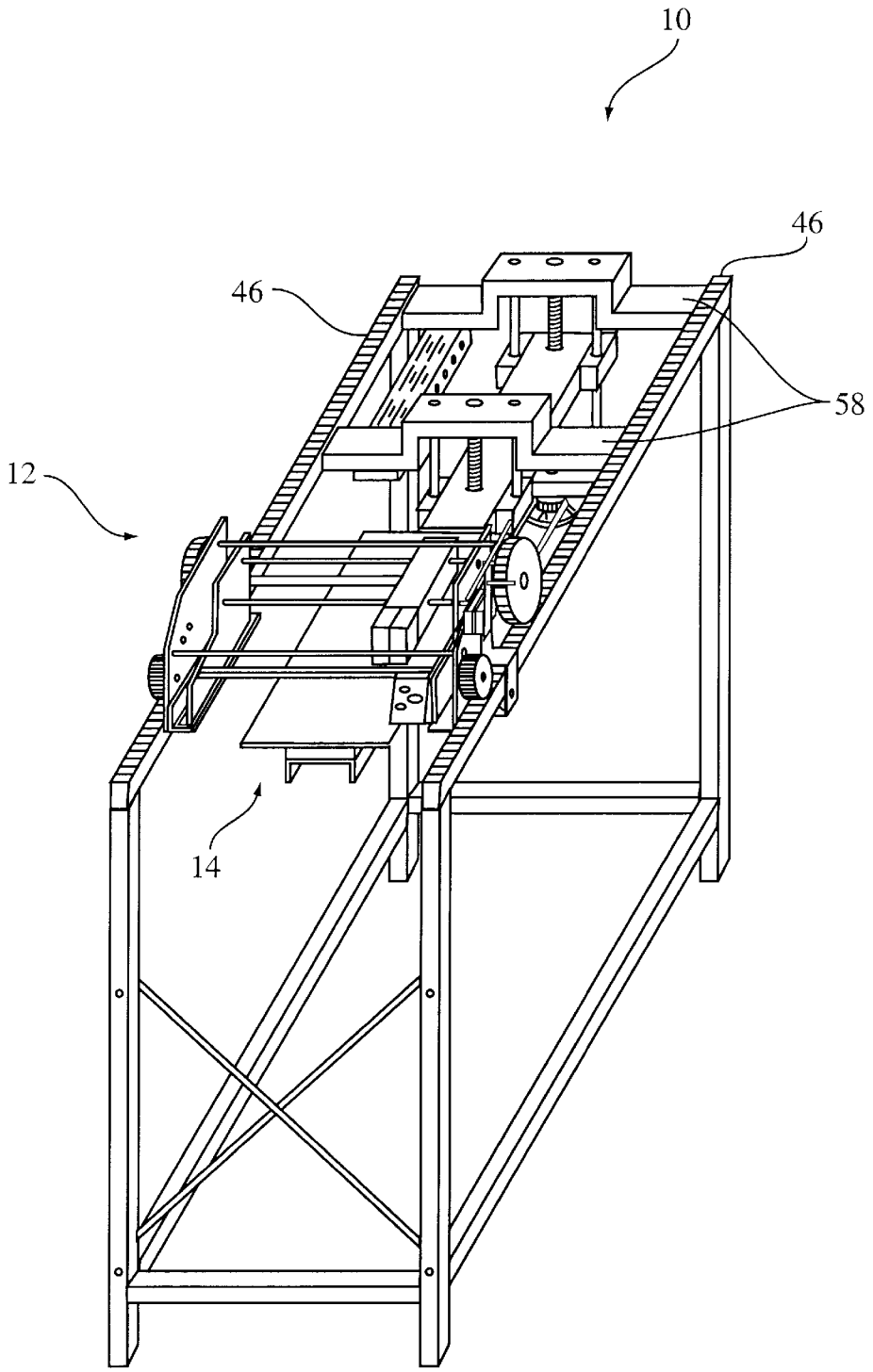
FIG. 4 is perspective view of a ink jet printing apparatus having an ink-jet printing station and a printing palette, both in accordance with an alternate embodiment of the present invention.

FIG. 4 illustrates in schematic an alternate embodiment of the ink jet printer 10 of the present invention with various components removed for clarity in which relative movement is produced between a moveable printing station 12 and a stationary printing palette 14 supported beneath a pair of inverted trough shaped bars 58. As illustrated further in FIG. 5, printing head 24 is adapted to be moveable along a pair of platform rails 46 attached onto frame 18. Printing head 24 is mounted on threaded rod 43 secured in side blocks 44, a motor 45 attached to a side block 44 or provided integral to printing head 24 to provide motorized movement of the printing head 24 over the stationary fabric by rotating interaction between the printing head 24 and the threaded rod 43. End blocks 44 are carried by a pair of drive gears 50 meshed with platform rails 46. Rotation of drive gears 50 by a drive motor 56 produces movement of the printing head 24 parallel to a longitudinal axis of printing palette 14 so that travel of the printing head 24 along motorized threaded rod 43 provides perpendicular movement between the carriage 24 and the palette 14. It is important to include a pair of idler gears 52 and a keeper 54 (best seen in FIG. 7) so as to achieve smooth movement of the printing head 24 in a horizontal plane parallel to printing palette 14 without backlash effects and without changes in distance between the printing head 24 and printing palette 14. A pair of printing station drive motors 56 integral to side blocks 44 may be used to effect rotation of drive gears 50 or alternately, a single drive motor 56 may be used in cooperation with a single drive shaft (not shown for purposes of clarity) extending between the side blocks 44 to rotate both drive gears 50. A pair of contact or proximity switches 51 are attached to the inside of frame 18 so that as palette 14 is driven along drive shaft 20, a locator tab 53 attached to palette 14 activates the switches 51. Signals from switches 51 are used to locate and verify positioning and movement of palette 14 along drive shaft 20.

Figure 5:
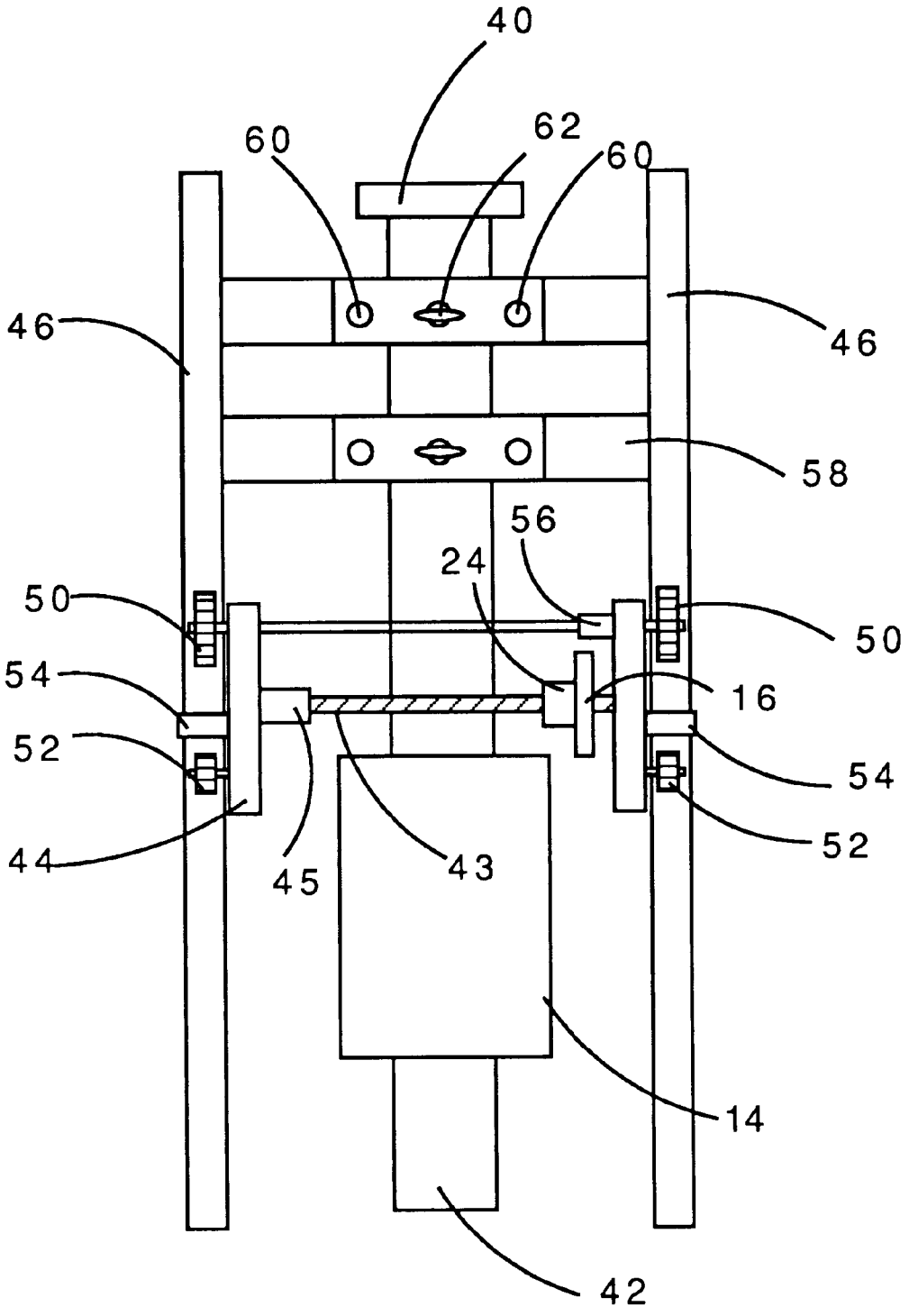
FIG. 5 is a schematic top plan view with portions of the jet printing station of the alternate embodiment of FIG. 4 removed to show a moveable ink-jet printing head.
Figure 6:
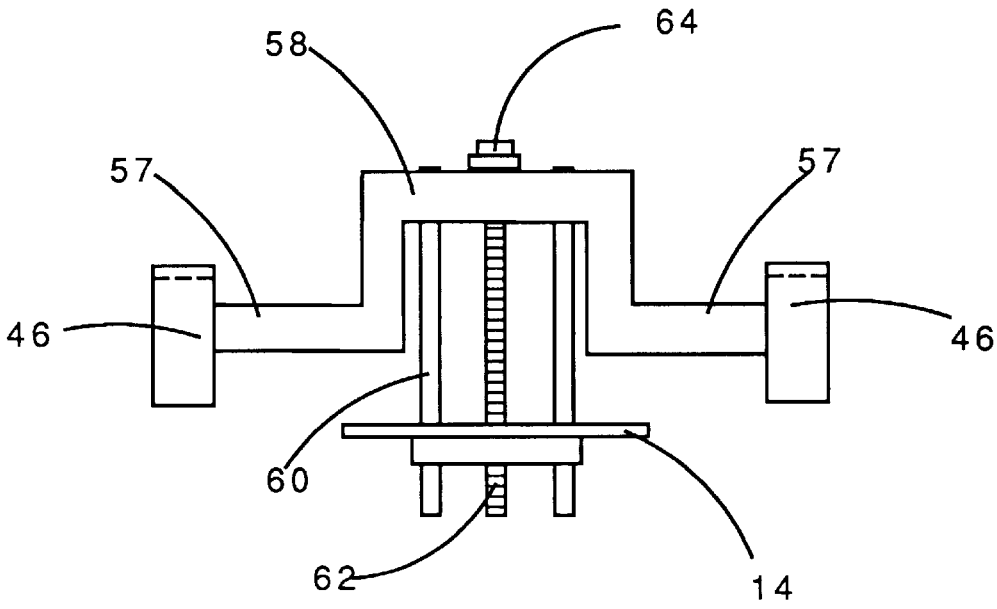
FIG. 6 is a schematic end elevational view of a stationary printing palette in accordance with an alternate embodiment of the present invention.

As seen in FIG. 6, in the alternate embodiment of FIG. 5, printing palette 14 is slideably mounted on a pair of vertical guide posts 60 depending from the inverted trough shaped bar 58 and is threadably mounted onto a threaded post 62 so that vertical movement of printing palette 14 is produced through rotation of a bell crank 64 located atop trough shaped bar 58. Trough shaped bar 58 is secured at its outer and lowermost ends 57 into platform rails 46. Due to this arrangement, controlled and coordinated movement of carriage 16 and printing head 24 along both the threaded rod 43 and platform rails 46 makes it possible for an ink-jet dye nozzle (not shown) within carriage 24 to move horizontally across and longitudinally, in a line-wise manner, along a fabric secured onto palette 14 in a line-wise manner to produce an ink-jet printed pattern thereon. Control of printing station drive motors 56 and carriage motor 45 is accomplished in conjunction with a line-wise series of computer-controlled printing signals described hereinafter.

Figure 7:
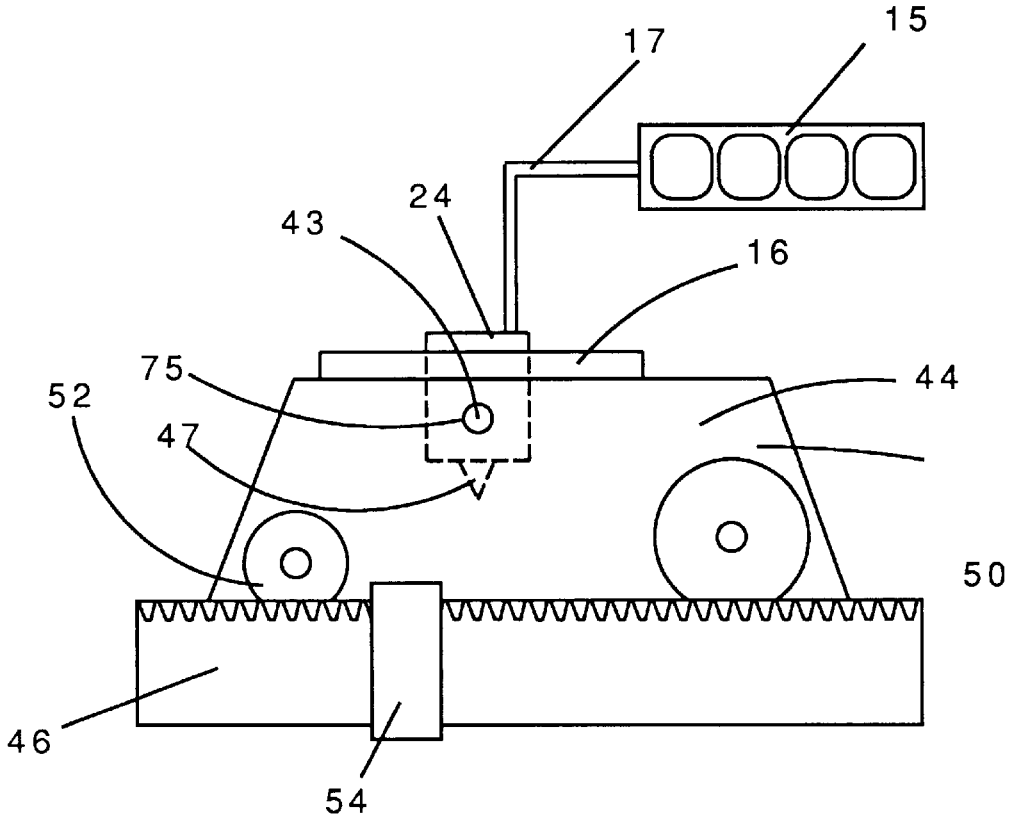
FIG. 7 is an enlarged elevational side view of a portion of the alternate embodiment of the present invention as illustrated in FIG. 6.

FIG. 7 is a cut-away schematic view to better illustrate various portions of the moveable printing head 24 supported by carriage 16 mounted on threaded rod 43, the threaded rod 43 secured in end blocks 44, end blocks 44 supported by drive gears 50 meshed with platform rails 46, idler gears 52 and keepers 54 being provided to ensure smooth movement of the moveable printing head 24 along the platform rails 46 without adverse effects from unwanted vertical motion of the printing head 24. Ink carriage motor 45 integral with the end blocks 44, or alternately integral with printing head 24 or alternately integral with carriage 16 and affixed directly to threaded rod 43, are utilized to provide transverse movement of carriage 16 and printing head 24 along the threaded rod 43. With this arrangement, ink jet nozzle 47 may move horizontally across a fabric secured onto palette 14 in a manner to produce an ink-jet printed pattern thereon in a linewise fashion as the printing head 24 is moved along gear rails 46.

Figure 8:
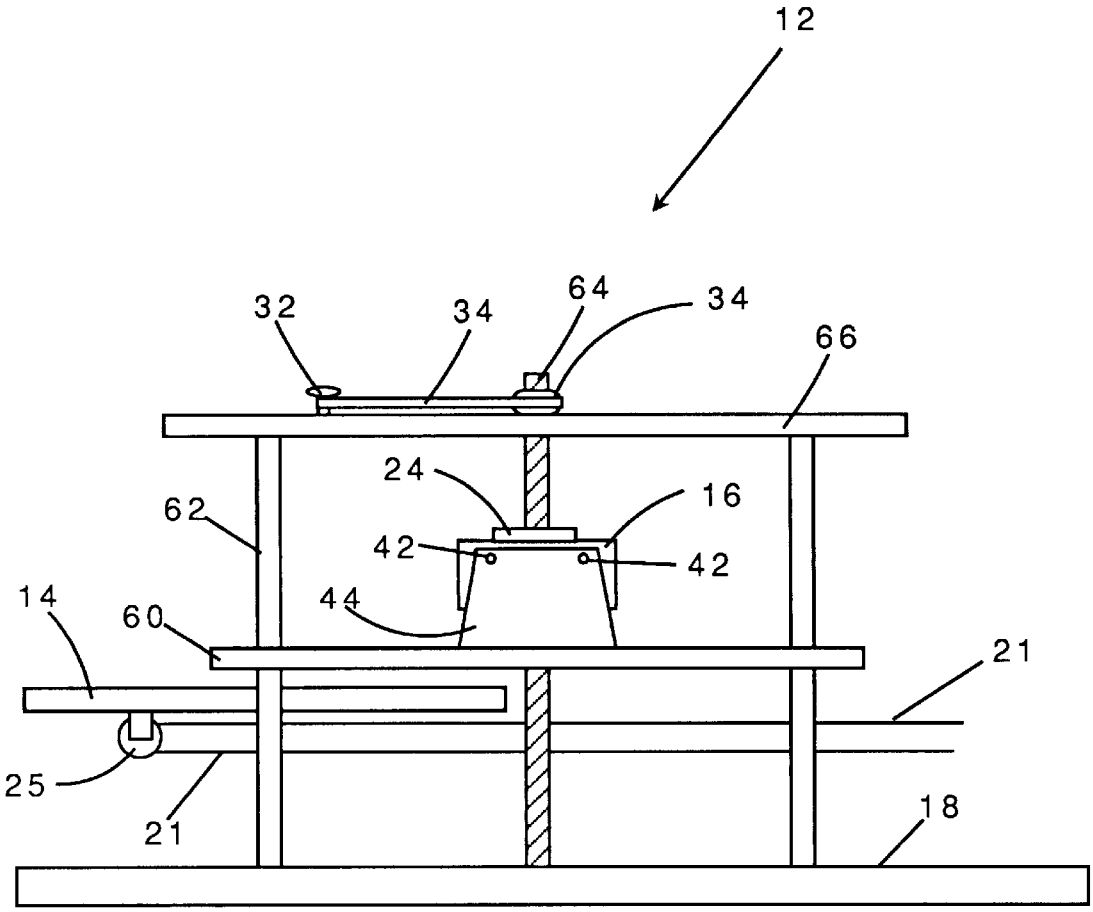
FIG. 8 is a side sectional view showing various components of the printing station of FIG. 2.

Now referring to FIG. 8, in conjunction with FIG. 3, ink-jet printing head 24 with printing nozzle 47 directed towards a fabric supported on printing palette 14 is shown mounted on printing carriage 16, the carriage 16 being moveable in a direction along threaded rod 43. As discussed previously, movement of the carriage 16 and the affixed printing head 24 may be effected using a stepping motor integral with the printing head 24 and having a drive gear meshed with threaded rod 43 or alternately, having a stepping motor integral with the threaded drive rod 43 and having a drive gear within printing head 24. Carriage 16 is shown mounted on threaded rod 43, the threaded rod 43 joined into side blocks 44 which are secured to a bottom side plate 60, the bottom side plate 60 being slideably mounted on a pair of vertical columns 62 to provide structural stability of the printing station 12 during printing, the bottom side plate 60 being threadably mounted on a threaded post 64 to provide vertical location of the printing station 12 during printing. A top plate 66 is secured to the vertical columns 62 and provides a stationary surface for engaging the two threaded posts 64 with two gear rollers 30 driven by a bell crank 32 using timing drive belt 34 (best seen in FIG. 2) to impart vertical movement of carriage 16 and printing head 24 in a vertical direction relative to platform 18 and printing palette 14 so as to accommodate different printing fabrics secured atop palette 14 and having differing thicknesses. Using this arrangement, in the instance of singular pieces of relatively flat fabric attached atop printing palette 14, the distance between printing palette 14 and the printing head 24 may be varied by rotation of bell crank 32 to optimize and maintain the printing distance between the fabric and the printing head. Flat fabrics having a relatively constant thickness but having different thicknesses may thereby be printed under optimized conditions regardless of the thickness of the fabric.

Figure 9:
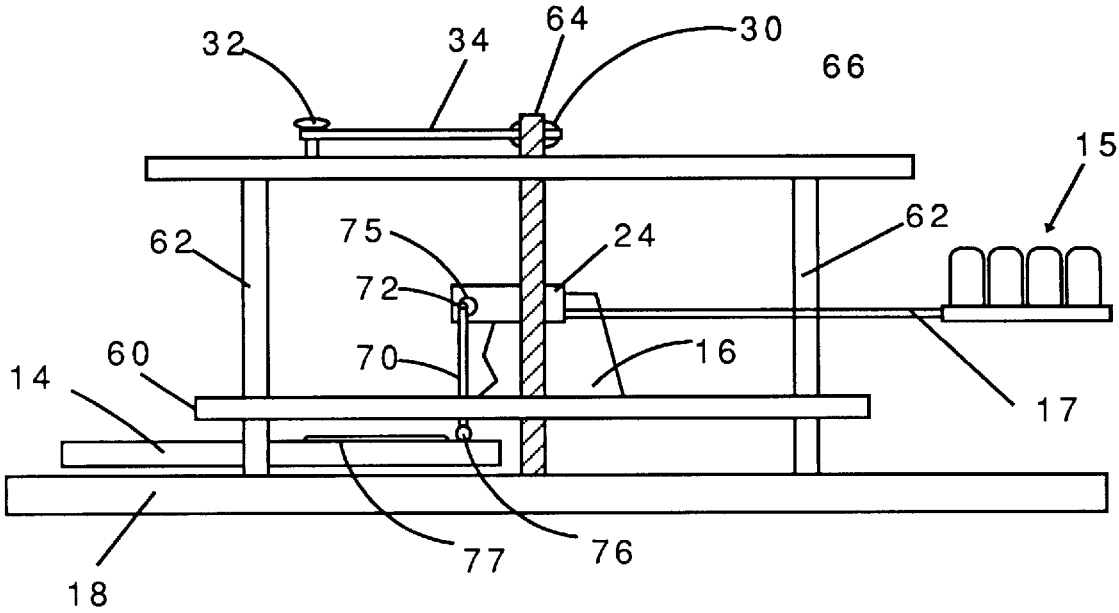
FIG. 9 is a schematic side elevational view of a printing station adapted for printing on fabric having an irregular surface in accordance with the present invention.
Figure 10:
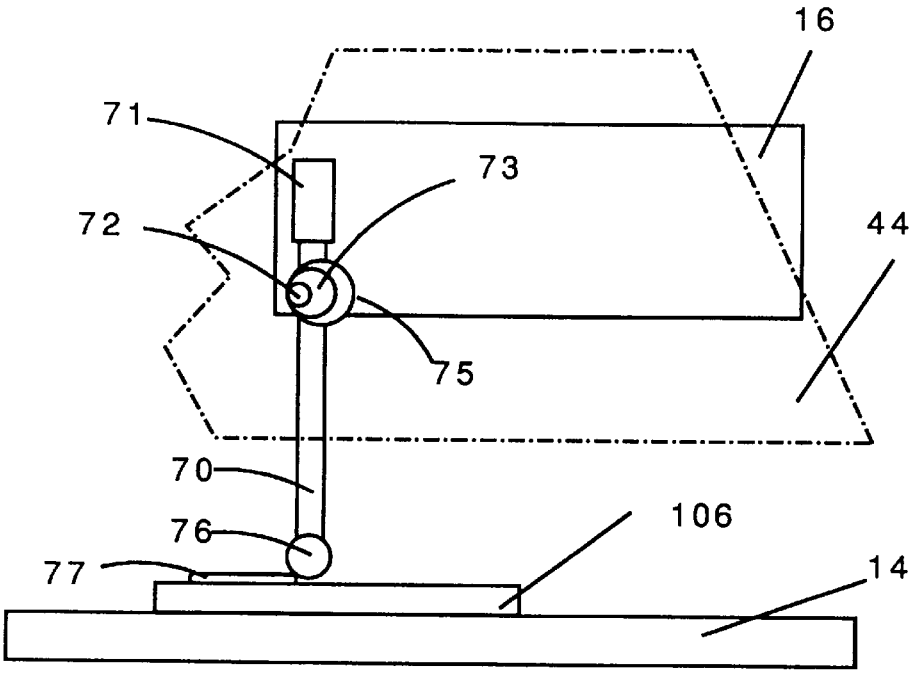
FIG. 10 is an exploded schematic side elevational view showing various components of the printing station of FIG. 9.
Figure 10A:
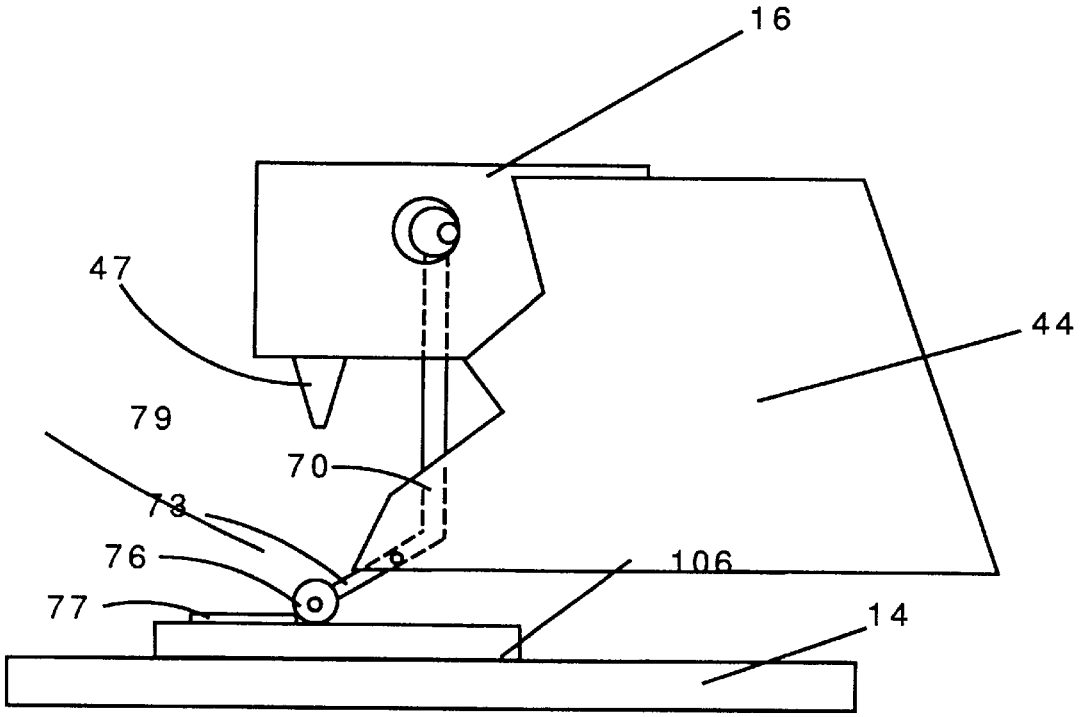

FIGS. 9 and 10 illustrate an important feature of the present invention wherein fabrics which are not relatively flat but which have abrupt changes in thickness, for example, as caused by seams or pockets, may also be printed with the distance between printing palette 14 and the printing head 24 varied automatically to optimize and maintain the printing distance between the fabric and the printing head. In this instance, the printing carriage 16 is slideably and rotatably mounted on threaded rod 43. A fabric height sensor 70 is attached to the threaded rod 43 and positioned so as to contact the fabric section to be printed directly between the printing nozzle 47 and the fabric to be printed upon, the height sensor 70 adapted to contact the fabric section attached atop printing palette 14, for example by rolling or sliding, as the printing palette passes beneath printing head 24 and move vertically upwards and downwards in direct proportion to vertical changes in the surface level of the fabric area being printed. As seen in FIG. 10, wherein side block 44 is shown in dot-dash lines for clarity of illustration, height sensor 70 has first and second ends, the first end comprising a roller 76 positioned in contact with the fabric, the second end attached to the guide rod 74 supporting the printing head, the second end having an eccentric cam portion 72 engaged within opening 75 in side block 44 to translate vertical movement of the first end over any irregular features of the fabric into a corresponding vertical displacement of the second end and thereby of the threaded rod 43 supporting the printing carriage 16. The uppermost end of sensor 70 is preferably housed in a spring loaded bushing 71 in order to maintain a vertical orientation as well as maintain a downward force on roller 76 in contact with irregular surfaces 77 on the fabric 104 being printed. Height sensor 70 thereby imparts a corresponding vertical movement to threaded rod 43, a movement that is translated thusly into a vertical displacement of the printing head 24 which directly corresponds to changes in thickness of the fabric being printed upon. Consequently, a constant distance is maintained between the printing head 24 and the fabric being printed upon as irregular surfaces 77 on the fabric like seams or pockets appear. In an exemplary embodiment, threaded rod 43 is formed with eccentric cam portions 72 at both ends of the threaded rod 43, the cam portions 72 mating into circular opening 75 in side blocks 44, the sizes of the cam portions 72 and circular opening 75 being chosen so that a ¼ inch vertical displacement of the printing head 24 is possible. As fabric attached to palette 14 and having varying thickness is presented to the printing head 24 (the relative movement between the palette 14 and the printing head 24 being provided by any of the several schemes described hereinbefore), the roller portion 76 of sensor 70 rolls over the fabric's upper surface and moves correspondingly vertically upwards or downwards. In response, the eccentric cam 72 moves correspondingly upwards or downwards within opening 75 and causes a correspondingly upwards or downwards motion of the threaded rod 43 and of the printing head 24. An alternate embodiment of sensor 70 is seen in FIG. 10A, wherein the lower end of sensor 70 is attached to a fulcrum arm 73, fulcrum arm 73 having roller 76 at its lowermost end in rolling or sliding contact with the fabric 104 and any irregular features 77 thereon. Fulcrum arm 73 pivots around a pin 79 in side plate 44 so as to move printing carriage 16 and thereby printing nozzle 47 vertically upwards and downwards in direct proportion to vertical changes in the surface level of the fabric area being printed.

Figure 11:
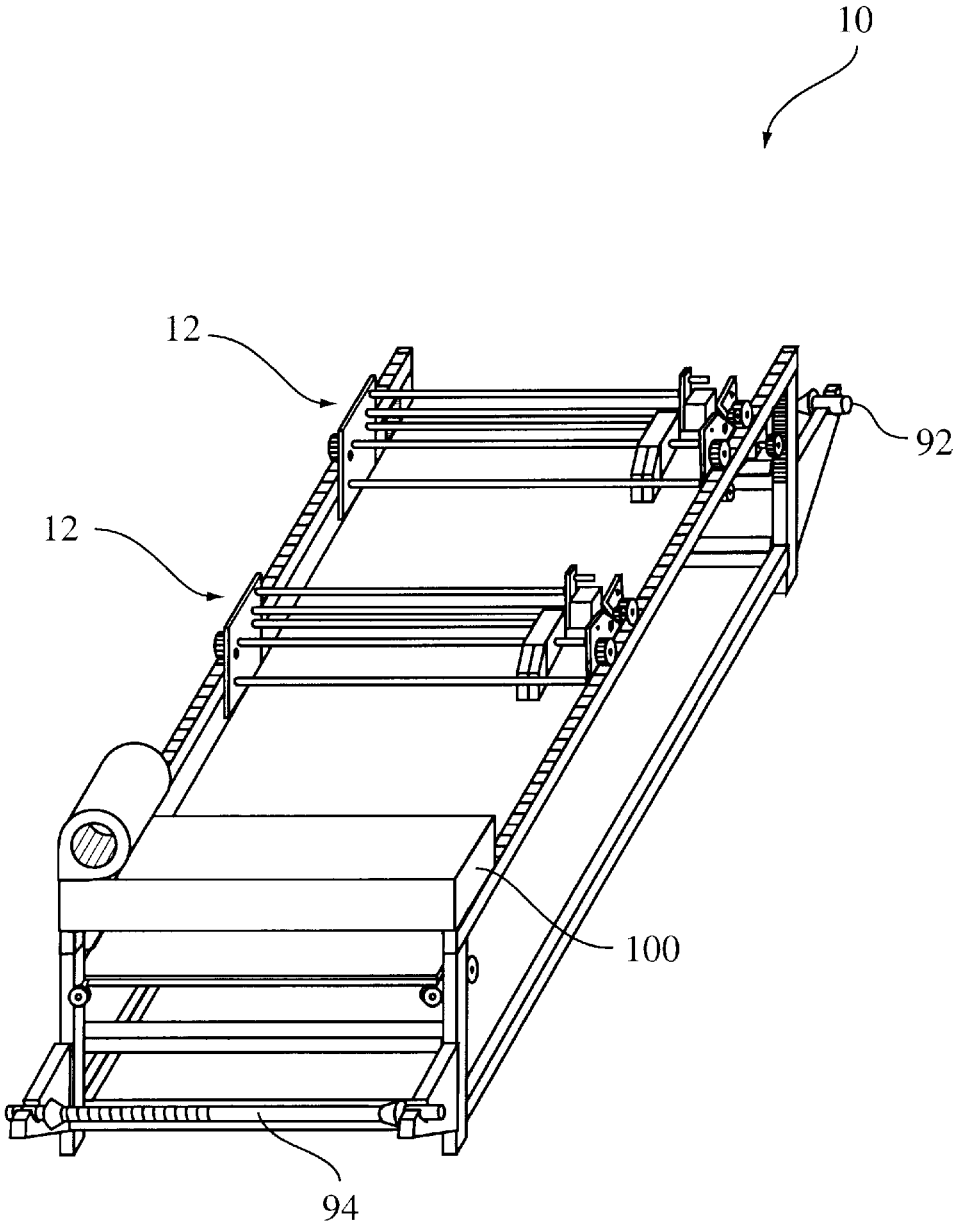
FIG. 11 is perspective view of a ink jet printing apparatus adapted for printing on continuous fabric materials in accordance with the present invention.
Figure 12:
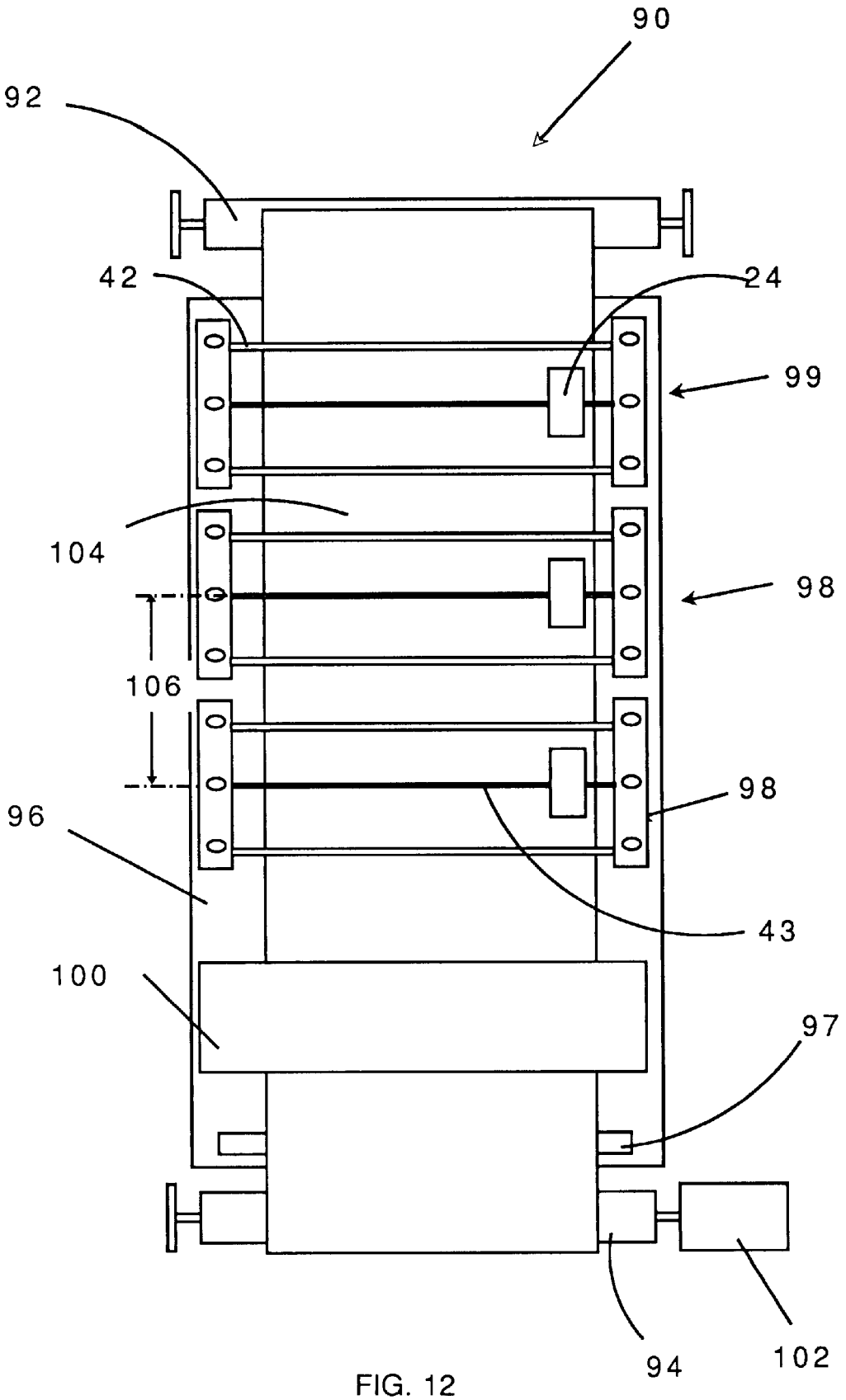
FIG. 12 is schematic top plan view of the ink jet printing apparatus adapted for printing on continuous fabric materials having a series of ink-jet printing stations, in accordance with the present invention.
Figure 13:
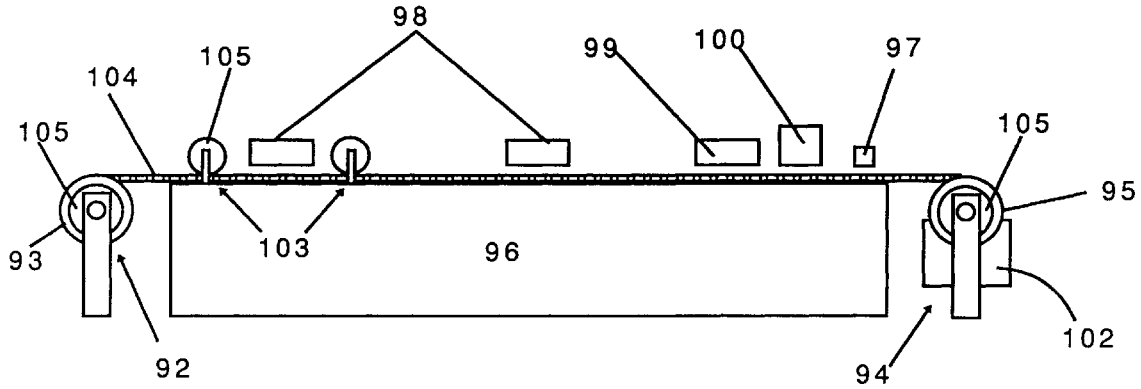
FIG. 13 is schematic elevational view with portions of the jet printing station of FIG. 12 removed to show the series of ink-jet printing stations.

FIGS. 11, 12, and 13 show a continuous feed fabric ink-jet printing machine 90 for printing on a roll of fabric having a fabric supply roller 92 and a fabric take-up roller 94 located at opposing ends of a stationary printing table 96 with a series of successively positioned printing stations 98 supported above the printing table 96 so that ink-jet printing may be accomplished as fabric is moved along the printing table 96 as previously described in conjunction with FIGS. 1 and 2. Fabric is moved section-wise along the printing table 96 as a result of cooperative rotation of take-up roller 94 and fabric supply roller 92, take-up roller 94 being rotated at an angular velocity to impart movement of fabric 104 along printing table 96, fabric supply roller 92 preferably being equipped with a constant drag force mechanism. In addition, a fabric drag mechanism 97, for applying pressure to the fabric 104 to prevent wrinkling of the fabric during rolling onto take-up roller 94 may be located on printing table 96 immediately preceding take-up roller 94. As a matter of convention, the single printing station 98 located adjacent the take-up roller 94 is designated as a leading edge printing station 99. An ink-fixing station 100 is supported above printing table 96 between the leading edge printing station 99 and the fabric take-up roller 94. Depending on the characteristics of the printing inks employed during a particular printing operation, ink-fixing station 100 may comprise a dry thermofix heating or wet steaming station or a liquid spray station for application of ink fixing chemicals, for example an alkaline steam, shock or cold-fix process. Take-up roller 94 is driven by a pulse stepped drive motor 102, controlled to impart movement of fabric 104 along printing table 96 so that a continuous supply of unprinted fabric material 104 may be section-wise moved beneath printing stations 98, fabric material being unrolled from the fabric supply roller 92 and re-rolled onto the fabric take-up roller 94.

FIGS. 12 and 13 illustrate an important feature of the present invention is accurate placement of the printing stations 98 so that the horizontal "printing distance", indicated as a distance 106 between two dot-dashed lines in FIG. 12, between ink-jet printing nozzles 47 of successive printing stations 98 is a constant distance. Using this arrangement, a section of fabric to be printed using ink jet printer 90 may be divided into a number of individual fabric printing sub-sections corresponding to the sub-image patterns described hereinafter, corresponding to the "printing distance" 106 shown located between dashed lines underneath two successive printing stations 98 in FIG. 12, the number of individual fabric printing sub-sections being equal to the number of printing stations 98 supported on table 96. As part of the printing process, the image to be printed as a continuous pattern on fabric 104 is divided into a corresponding number of next adjacent sub-image patterns, beginning with a leading edge sub-image pattern that can be printed upon fabric 104 as the printing stations 98 move linewise over the section of fabric to be printed with the image. Ink-jet printing of the sub-image patterns in a line-wise fashion is accomplished in a closely spaced series of ink printed lines extending traverse to the direction of motion of the fabric using the printing stations 98. In a typical printing operation, the printing stations 12 and fabric are moved relative to one another at a speed in a range between 4 inches and 6 inches per minute and a series of ink-jet printed pattern lines in the approximate range of 64 lines per inch are printed.

Figure 14:
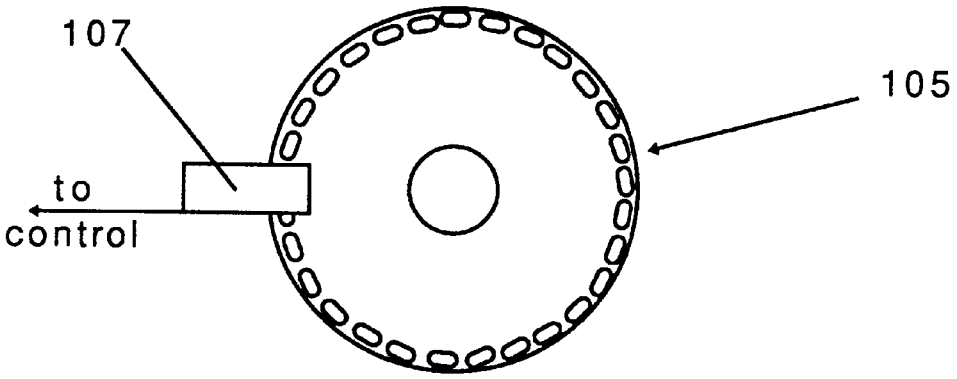
FIG. 14 is schematic view of a timing wheel used with the jet printing apparatus of FIG. 12; and, FIG. 15 is an ink filtration processing apparatus useful in preparing inks for ink-jet printing, in accordance with the present invention.
Figure 15:
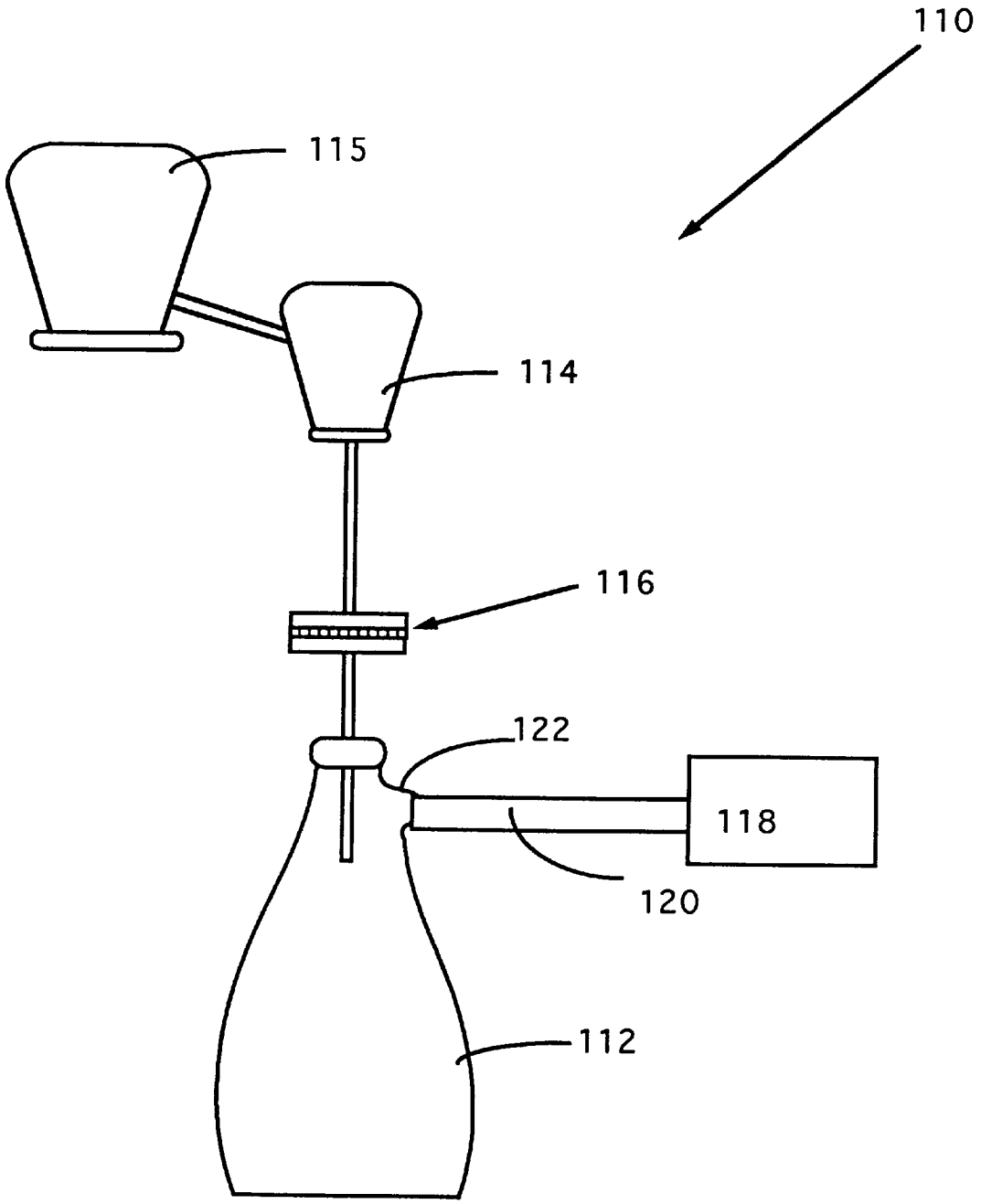

Printing of the sub-image pattern may be accomplished as described in conjunction with FIGS. 4 and 5 wherein each printing head 24 is adapted to be moveable along a pair of platform rails 46 and is moved over the stationary fabric by a rotating interaction between the printing head 24 and the printing rail 43. It is again important to include a pair of idler gears 52 and a keeper 54 (best seen in FIG. 7), the clamp-like keeper 54 adapted to perform like a rolling bracket between the end block 44 and rail 46 with bearings along the underside of rail 46 so as to achieve a tightly controlled and smooth movement of the printing head 24 in a horizontal plane parallel to printing palette 14 without backlash effects and without changes in distance between the printing head 24 and printing palette 14. This printing mode is well suited for printing images that are lengthy and repetitious, such as banners, etc. An alternate printing mode may be appropriate in which each of the multiple printing stations 98 produces a complete image with length less than the distance between successive printing stations 98. This alternate mode is best suited for repetitive images 24 inches of less in length. FIG. 13 slows a number of circular timing wheels 105 mounted concentricity with the fabric supply roller 92 and the fabric take-up roller 94 as well as positioned in rolling contact with fabric 104 immediately before and after one printing station 98. (Timing wheels 105 are positioned immediately before and after all printing stations 98 but are illustrated only for one station 98.) As seen in FIG. 14, the timing wheels 105 are perforated near their the outer diameters so that light from a photo diode source, for example, located on one side of the wheel 95 may be intercepted by a photodetector 107, the frequency or number of intercepted alternating light signals being indicative of the angular velocity of rollers 92 and 94 and thereby the angular distance moved by fabric 104 from the supply roller 92 and onto the fabric take-up roller 94. The frequency or number of intercepted alternating light signals are provided to the control portion of the ink-jet printer 10 where a comparison is made between the amount or rate of fabric unrolled from the supply roller 92 and the amount or rate of fabric rolled up onto the fabric take-up roller 94. If these amounts differ more than a predetermined maximum, the machine is stopper automatically and a feed error signal is provided to the operator. FIG. 13 further slows additional timing wheels 105 positioned in rolling contact with fabric 104 immediately before and after printing station 98; that is, positioned in contact with fabric 104 being printed on the ink-jet printer 10 of FIG. 13 so that the frequency or number of intercepted alternating light signals by a conventional photodetector sensor is indicative of the angular distance moved by rollers 92 and 94 and thereby is indicative of the linear distance moved by fabric 104 being printed on the ink-jet printer 10 before and after printing station 98. A comparison circuit uses the alternating light signals indicative of the amount and rate of fabric unrolled from the supply roller and the amount and rate of fabric rolled up onto the fabric take-up roller to insure that the fabric is moved under the printing stations without exceeding predetermined bunching or stretching limits. If these amounts differ more than predetermined maximum and minimum values, respectively, the machine is stopper automatically and a fabric feed error signal is provided to the operator. Sub-routines within the control circuitry are also adapted to analyze signals from the timing wheels 105 positioned in rolling contact with fabric 104 immediately before and after printing station 98 to insure that the fabric is accurately stopped in a proper printing position and remains in a proper linear position to have a continuous printed pattern printed on the fabric without gaps or overlapping.

Each of the printing stations 98 as well as the leading edge printing station 99 within continuous feed fabric ink-jet printing machine 90 may be supported with the arrangement as shown in FIG. 8 for printing upon a relatively flat supply of unprinted fabric. In such case, the printing stations 98 are mounted on printing carriage 16, carriage 16 being secured to a bottom bracket 60, the bottom bracket 60 being slideably mounted on a pair of vertical columns 62 attached to printing table 96 to provide structural stability of the printing station 98 during printing, the bottom bracket 60 being threadably mounted on a threaded post 66 to provide vertical location of the printing station 12 during printing.

Alternately, printing stations 98 and leading edge printing station 99 may be supported with the arrangement as shown in FIGS. 9 and 10 for printing upon a continuous supply of unprinted fabric having irregular surfaces, for example as caused by seams or other irregular features within the continuous supply of unprinted fabric. In such an instance, distance between printing table 96 and the printing stations 98 is varied automatically to optimize and maintain the printing distance between the fabric and the printing head 24. As described in conjunction with FIGS. 9 and 10, printing stations 98 comprise printing heads 24 and a carriage 16 which is slideably and rotatably mounted on a single threaded rod 43 so that carriage 16 supporting printing heads 24 and printing nozzles 47 is able to rotate angularly around the threaded rod 43. A fabric height sensor 70 is attached to the threaded rod 43 and positioned so as to contact the fabric section to be printed directly between the printing head 24 and the fabric to be printed upon, the height sensor 70 adapted to roll along fabric section attached atop printing palette 14 as the printing palette 14 passes beneath printing nozzle 47 and move vertically upwards and downwards in direct proportion to vertical changes in the surface level of the fabric area being printed. Height sensor 70 imparts a corresponding vertical movement to printing nozzle 47, again so that a constant distance is maintained between the printing stations 98 and the fabric being printed upon as irregular surfaces on the fabric like seams or pockets appear. As before, threaded rod 43 is formed with eccentric cam portions 72 at both ends of the threaded rod 43, the cam portions 72 mating into circular opening 75 in side blocks 44 so that an additional upwards or downwards motion of the printing head 24 is achieved because of the eccentric nature of the cam portions 72 at both ends of the threaded rod 43 as the eccentric cams also rotate slightly within circular openings 75 in side blocks 44. These features are not shown in FIGS. 11 and 12 as they are illustrated fully in FIGS. 9 and 10.

The ink for the ink jet printing for use in the present invention may be prepared by dissolving or dispersing a suitable textile dye in a solution of filtered water, preferably wherein no organic solvent is contained in the inks to achieve the desired printing results. Dyes preferably used in the present invention include add dyes, direct dyes, reactive dyes, animal dyes, etc. Of these, reactive dyes and acid dyes are especially preferable. Standardized yellow, magenta, cyan and black dye colors are typically used and these are capable of producing most of the graphic patterns generated by designers. Other, more exotic dyes having specialty colors may also be used. In those instances when specialty colored inks are prepared, organic solvents may be necessitated, however such occurrences are exceptional.

The amount of dye used in a filtered water solution ranges from 2 to 25 weight-percent with respect to the total ink amount, depending upon the individual dye being used to prepare colored ink. Generally, experiential methods are employed before an optimized set of fabric dyes may be achieved. A particularly useful set of standard colored printing inks may be made using textile reactive dyes commercially available as Procion™ dyes, fiber reactive dye types available from ICI Chemical Co. Using these dyes, in conjunction with a standard Epson 400 ink jet printer, available from Epson of America, and printing on cotton and rayon fabrics, a useful set of standard printing inks may be prepared by using: a concentration within a range of about 10% to 15% by weight of yellow dye (Procion™ part number 3) mixed in a solution of purified water; a concentration within a range of about 10% to 15% by weight of magenta dye (Procion™ part number 13) mixed in a solution of purified water; a concentration within a range of about 15% to 25% by weight of cyan dye (Procion™ part number 25) mixed in separate solutions of purified water; and a concentration within a range of about 15% to 30% by weight of black dye (Procion™ part number 44) mixed in a solution of purified water. These values are subject to a wide range of utility as the optimum amount of ink to be transferred depends on a combination of factors, including the color balance characteristics of the printed pattern, the speed of printing, the nozzle characteristics as well as the type of textile material being printed.

An aqueous based ink composition containing the dyes as described above can be generally prepared by mixing the components by well known means such as a ball or roller mill, if necessary, and then subjecting the composition to a series of sequential filtration processes. The maximum particle size of the disperse dye has been found to be unexpectedly small for a successful printing of both single fabric sections and continuous rolls of fabric and it has been discovered that the details of the filtering process are critical to achieving an optimized set of fabric dyes. It is known that if the particle size is too large, there will be problems of nozzle clogging, etc. during the ink jet recording, or in the leveling property in the successive dye-fixing step. However there appears to be a further benefit in producing the printing inks of the ink-jet textile printing method of this invention by filtering the composition of purified water, which is a majority component of the liquid ink medium and the dyes in a series of filtration steps using progressively finer filters. FIG. 14 illustrates a filtration device 110 for ink production in which ink compositions are drawn into an ink receiving flask 112 from a dye supply jar 114 through a filter press 116 using a vacuum source 118 connected with vacuum tubing 120 as shown to a necked opening in the ink receiving flask 112. Ink compositions are first mixed for instance using a drum on a roller mill and then filtered through a prefilter, for example a prefilter, available from Millipore Corporation, Bedford, Mass., and having a nominal filtering diameter of 47 microns, into supply jar 114 as a prefiltered dye solution. A secondary, larger volume reservoir 115 may be connected to dye supply jar 114 if desired to increase throughput. This 47 micron prefiltered ink solution is subsequently successively refiltered by using filtration device 110 through filter press 116 using a series of filters having nominal particle diameters of 5, 0.65 microns, 0.22 microns, and finally through a filter having nominal particle diameters of 0.10 micron to provide a supply of filtered ink solution in ink receiving flask 112. Filters for this ink filtration process were obtained from Millipore Corporation as part numbers AP20-047-00, specifying the desired particle filtration diameters. Filtering was done using a Gast vacuum pump rated at 30 inches minute at a rate of 8 ounces of dye solution/minute. Larger volumes of ink may be filtered if needed by increasing the sizes of pumps.

Optionally, ionic dispersants or surfactants such as fatty acid salts, non-ionic dispersants or surfactants such as fatty acid esters and viscosity-controlling agents such as gum arabic, starch, etc. may be added as is well known in the art. A defoaming agent or a resistivity-controlling agent such as lithium chloride, ammonium chloride, or sodium chloride may optionally further be added thereto to optimize an ink for printing with different dye concentrations.

In operation, colored and filtered inks containing different dyes are filled into separate ink reservoirs connected by tubing to the different colored printing nozzles in printing head 24. Typically an individual reservoir may contain as much as one liter of ink to enable ink-jet printing of single pieces of fabric using the ink-jet printer of FIGS. 1 and 3 or to enable the ink-jet printing of continuous fabric rolls using the continuous fabric ink-jet printer as shown in FIGS. 11, 12 and 13. Graphic arts design and the subroutines needed for printing in color using computer-assisted publishing programs like Adobe PhotoShop™ graphics software application program, available from Adobe Systems, Mountain View, Calif. or Painter™ graphics software application program, available from Fractal Design, Aptos, Calif. and resident on a Gateway™ computer, model 2000, available from Gateway, Sioux City, S. Dak. are well known. For each controlled amount of forward movement of the textile material, an ink print line request is generated and one line of pattern data for different ink colors is sent from the host computer's memory buffer to activate the respective printing ink stations to cause the ink jet nozzles to apply ink in accordance with the data onto the respective lines of textile material thereunder. This printing pattern is repeated for each line of printed pattern on the single piece of fabric material. In the case of printing on continuous fabric rolls, a first section of the continuous fabric material is positioned below the individual ink-jet printing heads and the image to be printed is divided into a number of sub-images, the number of sub-images being equal to the number of individual ink-jet printing heads, the sub-images, when taken as a group replicating a portion of the image to be printed, the first section of the continuous fabric material to be printed being equal in size to the multiplied product of the number of individual ink-jet printing heads and the predetermined equidistant distance. The printing heads are then moved above the fabric for a distance equal to the predetermined equidistant distance, and, each of the sub-images is printed onto a section of unprinted material by activating each of the ink-jet printing heads during said relative movement. A subroutine within the data handling program is employed to divide the pattern to be printed into the required number subsets of pattern data corresponding to the number of printing stations 98 available in the continuous feed fabric ink-jet printing machine 90 and held in an electronic buffer means. During controlled forward movement of the roll of textile material, separate ink print line requests are generated for each one of the print stations 98 and a line of colored pattern data is sent from the host computer's memory buffer to each of the individual printing stations 98 to cause the printing stations 98 to apply ink in accordance with the data onto the respective lines of textile material thereunder. This printing pattern is repeated for each line of printed pattern is located in the section indicated by covering the printing distance 106 between successive print nozzles in printing stations 98.

The results of printing onto rayon, linen and silk fabrics with the method and apparatus of the present invention are characterized in the following Table wherein the term "Image" denotes accuracy of graphical or line detail in the printed image, and "Color" denotes accuracy of colored portions in the printed image. A numerical rating system is employed wherein "10" is fully acceptable in a commercially sold printed fabric product, "7" is acceptable in a commercially sold printed fabric product, and "5 or less" is not acceptable in a commercially sold printed fabric product. It can be seen that the methods and printers as described herein have been successfully employed for ink-jet printing on continuous rolls and single pieces of fabric, with and without seamed or other irregular features. Irregularities in the fabrics are accommodated successfully using the sensor 70 to raise or lower the printing head 48 maintaining a constant distance between the printing head 48 and the fabric being printed upon. In contrast, an unmodified commercial ink-jet printer, for example a Model 400 EPSON Ink-Jet Printer is unable to produce commercially acceptable products, especially on more loose weave fabrics like wool and linen. Results for ink-jet printing on wood and leather are included for illustration only.

TABLE

Results of Printing On Various Types of Fabric

| Fabric | Ink-Jet Printer of FIG. 1 | Ink-Jet Printer of FIG. 4 | Ink-Jet Printer of FIG. 11 | Standard EPSON Printer (Model 400) |
|---|---|---|---|---|
| Cotton | Image = 10<br>Color = 10 | Image = 10<br>Color = 10 | Image = 10<br>Color = 10 | Image = 3<br>Color = 3 |
| Silk | Image = 10<br>Color = 10 | Image = 10<br>Color = 10 | Image= 10<br>Color = 10 | Image = 5<br>Color = 7 |
| Rayon | Image = 9<br>Color = 9 | Image = 9<br>Color = 9 | Image = 9<br>Color = 9 | Image = 5<br>Color = 7 |
| Wool | Image = 7<br>Color = 7 | Image = 7<br>Color = 7 | Image = 7<br>Color = 7 | Image= 3<br>Color = 3 |
| Linen | Image = 8<br>Color = 8 | Image = 8<br>Color = 8 | Image = 8<br>Color = 8 | Image = 3<br>Color = 3 |
| Nylon | Image = 8<br>Color = 8 | Image = 8<br>Color = 8 | Image = 8<br>Color = 8 | Image = 5<br>Color = 5 |
| Paper | Image = 10<br>Color = 10 | Image = 10<br>Color = 10 | Image= 10<br>Color = 10 | Image = 10<br>Color = 10 |
| Wood | Image = 8<br>Color = 8 | Image = 8<br>Color = 8 | Image = 8<br>Color = 8 | Image = 3<br>Color = 3 |
| Leather | Image = 7<br>Color = 7 | Image = 7<br>Color = 7 | Image = 7<br>Color = 7 | Image = 5<br>Color = 5 |

While the present invention has been described with respect to what is presently considered to be exemplary embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet printer for printing an image on a single piece of fabric material with a plurality of colored inks, the fabric formed from materials selected from the group consisting of cotton, linen, rayon, nylon, silk and wool, the inks comprising an amount of reactive dye between about 0.5 and 1% by weight in an aqueous liquid medium, wherein no organic pretreatment is applied to the fabric, wherein no backing paper is applied to the fabric, and wherein no organic solvent is contained in the inks, the printer comprising:

a printing platform having an upper surface;

a printing station mounted on the upper surface of the printing platform;

a printing palette moveably supported along a pair of tracks parallel to the upper surface of the platform and below the printing station;

an ink supply reservoir holding inks of different colors;

wherein the printing station comprises an ink-jet printing head having printing nozzles directed toward the palette, the ink-jet printing head being mounted on a printing carriage, the carriage being moveable in a direction perpendicular to the direction of movement of the printing palette, so that when a printing signal, representative of a pattern to be printed, is provided to the printing head, ink of an appropriate color flows to the printing nozzles from the ink supply reservoir and the image to be printed is formed on the fabric material supported on the palette as the palette is moved relative to the printing station, wherein the printing head is mounted to the printing station using a threaded rod and further comprises a height adjustment means for vertically moving the printing head in response to irregular surface features within the fabric material, said height adjustment means comprising eccentric cams at opposing ends of the threaded rod mated into circular openings within a side block mounted on the printing platform and a roller in contact with the fabric and with the threaded rod; and, contact or proximity switches attached to the printing platform and a locator tab attached to palette so that as the palette is moved relative to the printing station, the locator tab activates the switches to locate and verify positioning and movement of the palette.

2. An ink-jet printer for printing an image on a continuous roll of fabric material with a plurality of colored inks, the fabric formed from materials selected from the group consisting of cotton, linen, rayon, nylon, silk and wool, the inks comprising an amount of reactive dye between about 0.5 and 1% by weight in an aqueous liquid medium, wherein no organic pretreatment is applied to the fabric, wherein no backing paper is applied to the fabric, and wherein no organic solvent is contained in the inks, the printer comprising:

a printing platform having an upper surface and first and second opposing ends, the upper surface supporting;

a fabric take-up roller capable of accepting a continuous roll of fabric located at the first end of the printing platform and rotatable by a motor;

a fabric supply roller located at the second end of the platform capable of supplying a continuous roll of fabric, the take-up roller and supply roller cooperatively activated to move a section of fabric onto the printing platform;

a series of successively equally spaced apart ink-jet printing stations adapted to print with colored ink and supported above the platform, the printing stations moveable over a sub-section of the fabric on the printing platform so that the image to be printed may be divided into a corresponding number of next adjacent sub-image patterns printed as the printing stations move over sub-sections of fabric located between two successive printing stations, the number of individual fabric printing sub-sections being equal to the number of printing stations, wherein the printing stations are mounted to the printing platform using a threaded rod and further comprises a height adjustment means for vertically moving the printing stations in response to irregular surface features within the fabric material, said height adjustment means comprising eccentric cams at opposing ends of the threaded rod mated into circular openings within a side block mounted on the printing platform and a roller in contact with the fabric and with the threaded rod; and, timing wheels perforated near their outer diameters, the timing wheels mounted above the printing platform immediately before and after the printing stations and in rolling contact with the fabric to be printed, and a light source and a light sensor adapted to cooperate with the timing wheels so that alternating light signals indicative of a linear distance moved by fabric may be analyzed to insure that the fabric is in a proper position to have a continuous printed pattern without gaps or overlapping.

3. An ink-jet printer for printing an image on a continuous roll of fabric material with a plurality of colored inks, the fabric formed from materials selected from the group consisting of cotton, linen, rayon, nylon, silk and wool, the inks comprising an amount of reactive dye between about 0.5 and 1% by weight in an aqueous liquid medium, wherein no organic pretreatment is applied to the fabric, wherein no backing paper is applied to the fabric, and wherein no organic solvent is contained in the inks, the printer comprising:

a printing platform having an upper surface and first and second opposing ends, the upper surface supporting;

a fabric take-up roller capable of accepting a continuous roll of fabric located at the first end of the printing platform and rotatable by a motor;

a fabric supply roller located at the second end of the printing platform capable of supplying a continuous roll of fabric, the take-up roller and supply roller cooperatively activated to move a section of fabric onto the printing platform;

a series of successively equally spaced apart ink-jet printing stations adapted to print with colored ink and supported above the printing platform, the printing stations moveable over a subsection of the fabric on the printing platform so that the image to be printed may be divided into a corresponding number of next adjacent sub-image patterns printed as the printing stations move over sub-sections of fabric located between two successive printing stations, the number of individual fabric printing sub-sections being equal to the number of printing stations, wherein the printing stations are supported by the printing platform using a threaded rod and further comprises a height adjustment means for vertically moving the printing stations in response to irregular surface features within the fabric material, said height adjustment means comprising eccentric cams at opposing ends of the threaded rod mated into circular openings within a side block mounted on the printing platform and a roller in contact with the fabric and with the threaded rod; and, timing wheels perforated near their outer diameters, the timing wheels mounted concentricity with the supply and take-up rollers, and a light source and a light sensor adapted to cooperate with the timing wheels so that alternating light signals indicative of an amount and rate of fabric unrolled from the supply roller and the amount and rate of fabric rolled up onto the fabric take-up roller may be analyzed to insure that the fabric is accurately stopped in a proper printing position and is moved under the printing stations without exceeding predetermined bunching or stretching limits.

* * * * *